United States Patent [19]

Brown, Jr. et al.

[11] 4,091,228

[45] May 23, 1978

[54] WATER COOLED SHELL FOR ELECTRIC ARC FURNACES

[75] Inventors: Joseph L. Brown, Jr., Hopewell Township, Beaver County; Dominic Fragomeni, Brighton Township, Beaver County; James J. Trageser, Pittsburgh, all of Pa.

[73] Assignee: United States Steel Corporation, Pittsburgh, Pa.

[21] Appl. No.: 687,589

[22] Filed: May 19, 1976

[51] Int. Cl.[2] ..... F27D 1/12

[52] U.S. Cl. ..... 13/32

[58] Field of Search ..... 13/10, 35, 32; 437/238; 266/280, 282, 283

[56] References Cited

U.S. PATENT DOCUMENTS

| | | | |
|---|---|---|---|
| 3,717,713 | 2/1973 | Schlienger | 13/35 X |
| 3,871,632 | 3/1975 | Wunsche | 13/10 X |
| 3,885,082 | 5/1975 | Hanas | 13/35 |

*Primary Examiner*—R. N. Envall, Jr.
*Attorney, Agent, or Firm*—John F. Carney

[57] ABSTRACT

The walls of a furnace are water cooled by a wall construction that comprises a pair of closely spaced, parallel plates defining a coolant flow passage. The plates are connected at their opposite ends to headers that place the passage in fluid communication therewith. According to one aspect of the invention the plates are formed as concentric annuli that encircle the furnace interior while the headers are ring headers. According to another aspect of the invention the walls are constructed of modular panels employing the inventive concept.

8 Claims, 11 Drawing Figures

WATER COOLED SHELL FOR ELECTRIC ARC FURNACES

BACKGROUND OF THE INVENTION

Erosion of the refractory lining is a significant cost factor in the operation of metallurgical furnaces. There are several mechanisms by which the refractory can be eroded, such as by simple melting, chemical dissolution by hot melts or slags, spalling due to thermal cycling and mechanical erosion by impaction of liquid or solid particles. These mechanisms may operate singly or in combination with one another and often erosion will occur in localized regions of the furnace. Regardless of the form the erosion takes, its severity accelerates in direct proportion to the temperature to which the refractory material is subjected.

Where erosion is severe it is necessary to terminate operation of the furnace in order to repair or replace the affected material. In some instances lining life can be extended by temporary hot patching; however, it has been proposed to reduce the severity of erosion by providing means for water cooling the refractory lining or the furnace wall to which it is applied. These cooling means serve to remove the heat input to the lining thereby to cool the adjacent refractory material. Examples of such water cooling apparatus are disclosed in U.S. Pat. Nos. 3,593,975, 3,598,382, 3,679,194 and 3,777,043.

Although the cited water cooling apparatus is effective to extend refractory lining life, their effectiveness is influenced negatively by the fact that they commonly operate at such coolant flow velocities that steaming is apt to occur. When steaming occurs the hot surface of the water jacket is prone to have formed thereon a steam blanket which is a thin layer of vapor. This layer of vapor acts as a thermal insulator thereby retarding the transfer of heat from the refractory lining into the coolant fluid and concomitantly reducing the effect of the fluid cooling.

It is to the improvement of such apparatus therefore that the present invention is directed.

SUMMARY OF THE INVENTION

According to the present invention there is provided apparatus for fluid cooling a furnace wall comprising a pair of closely spaced, parallel plates defining a flow passage; a pair of oppositely spaced manifolds attaching opposite ends of said plates to dispose the ends of said passage in fluid communication with the interior of the respective manifolds and means for circulating coolant fluid through said manifold and flow passage.

For a better understanding of the invention, its operating advantages and the specific objectives obtained by its use, reference should be made to the accompanying drawings and description which relate to a preferred embodiment thereof.

DESCRIPTION OF PREFERRED EMBODIMENTS OF THE INVENTION

Figure 1:
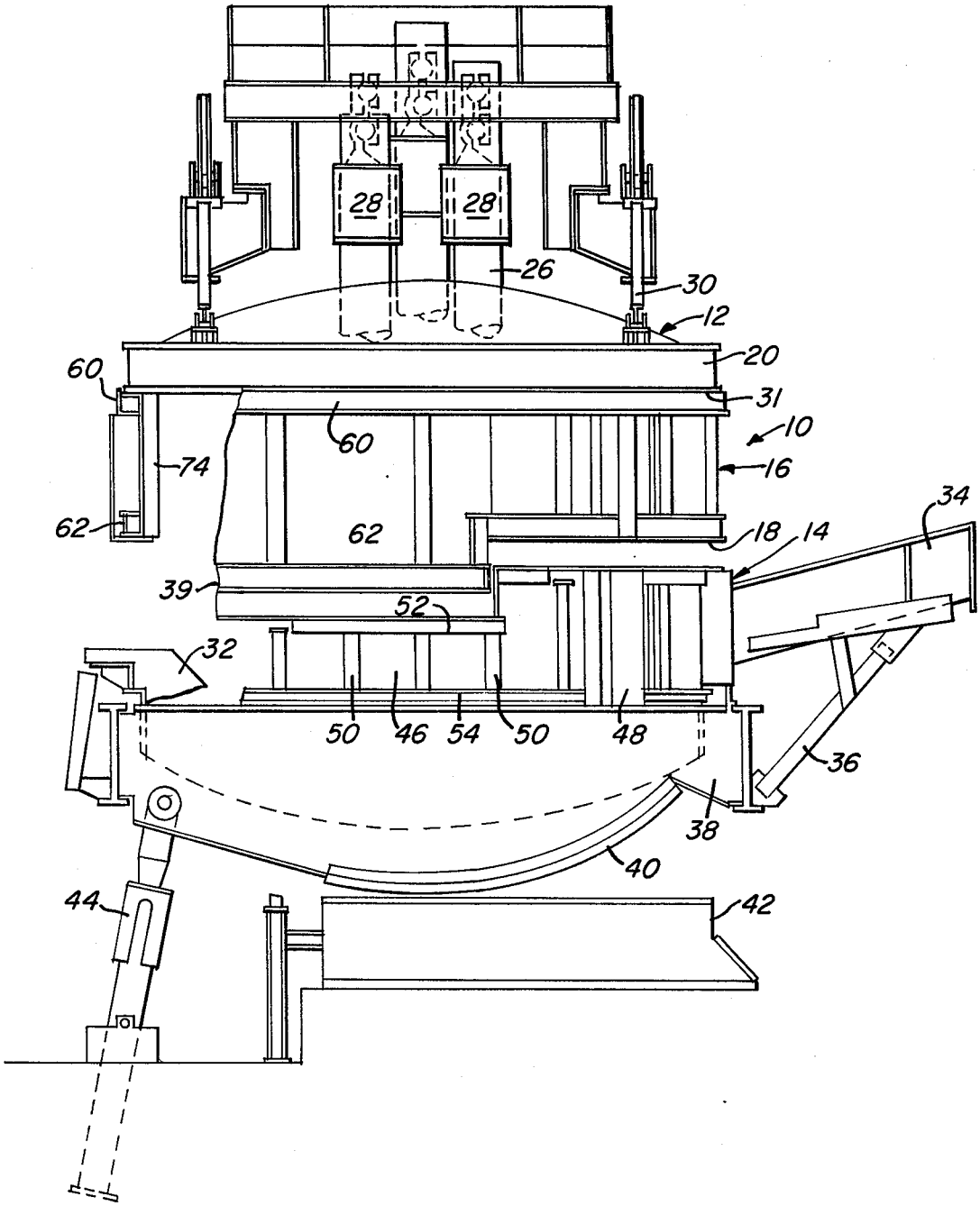
FIG. 1 is an elevational view, partly in section, of an electric furnace constructed according to one preferred form of the present invention.
Figure 2:
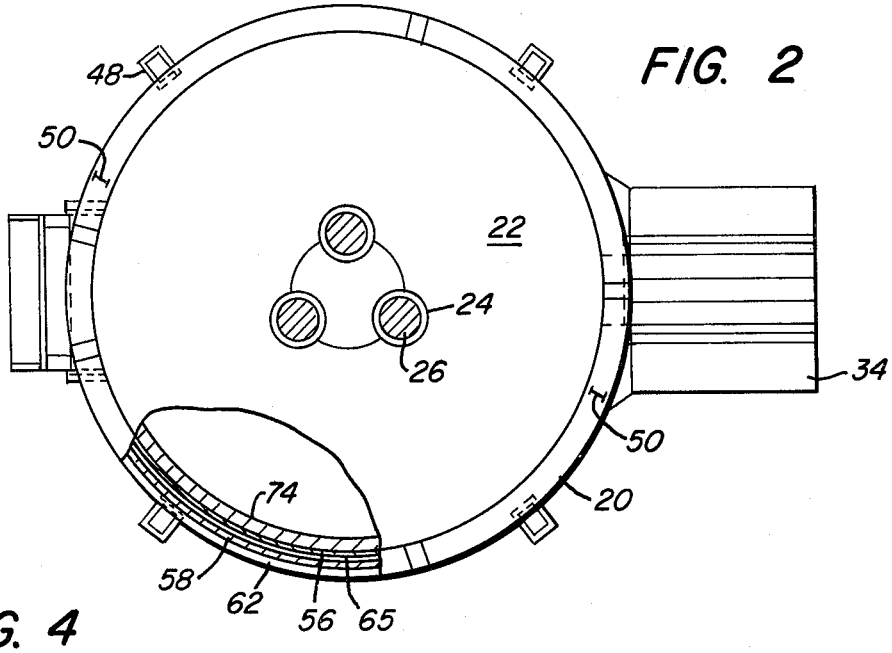
FIG. 2 is a plan view, partly in section, of the furnace of FIG. 1.
Figure 3:
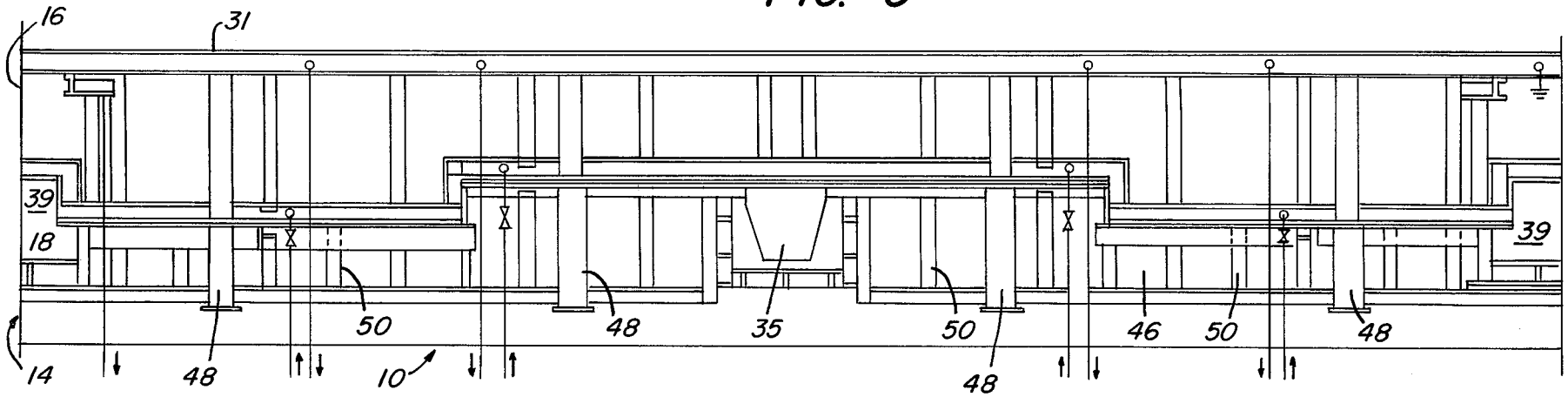
FIG. 3 is a developed view of the furnace of FIG. 1.

Referring to FIGS. 1, 2 and 3 of the drawing there is shown one form of electric furnace 10 provided with means for fluid cooling its sidewall according to one embodiment of the invention. The furnace 10 illustrated in these figures is of the split walltype and is divided into three major sections indicated as top section 12, lower shell and bottom section 14 and upper shell section 16. Division between the lower shell and bottom section 14 and upper shell section 16 occurs along split line 18.

Top section 12 includes an annular, water cooled roof ring 10 and a brick arch roof 22 that closes the top of the furnace. The roof 22 contains a plurality of through-openings 24 that accommodate passage of heating electrodes 26. The electrodes 26 are suspended from holders 28 located above the unit and are adapted to be raised and lowered to and from the furnace interior by means well known in the art. The roof ring 20 attaches to lift mechanisms 30 that operate to raise the top section 12 along a second split line indicated as 31 whereupon a crane, (not shown) or the like, is effective to move the same laterally thus exposing the furnace interior so that charge materials can be deposited therein.

The furnace bottom in the section 14 includes a bottom well 32 formed of refractory brick and adapted to receive the furnace charge and retain the resultant molten bath. A spout 34 extends laterally from an opening 35 in the section 14 and is supported by struts 36 connected between the spout and the furnace cradle 38 that forms the furnace bottom mount. A second opening 39 on the opposite side of the section 14 provides access to the furnace interior by workmen and is closable by a door (not shown). The furnace cradle 38 is formed along its bottom with a curved surface indicated as top rocker 40, which surface may be toothed as is conventional. Top rocker 40 is mounted on a flat bottom track 42 whereby the furnace can be tilted for pouring. Such tilting of the furnace is effected by the operation of hydraulic ram 44 that connects between the cradle 28 and floor footings.

The lower shell 46 that forms the upper portion of section 14 comprises a generally cylindrical wall that forms part of the furnace sidewall assembly. Shell 46 is framed by a plurality of upstanding structural members that include main supports or buckstays 48 disposed at four spaced points about the periphery of the wall and a number of columns 50 spacedly disposed intermediate the buckstays. The upper and lower ends of the columns 50 are tied by framing angles 52 and 54 that encircle the furnace section.

Figure 4:
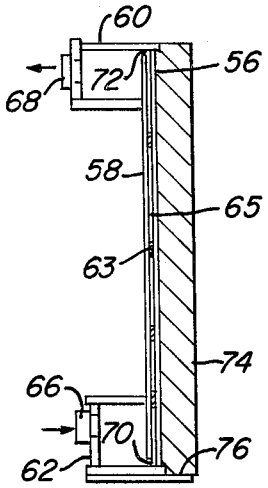
FIG. 4 is an enlarged view of the upper shell portion shown in section in FIG. 1.
Figure 7:
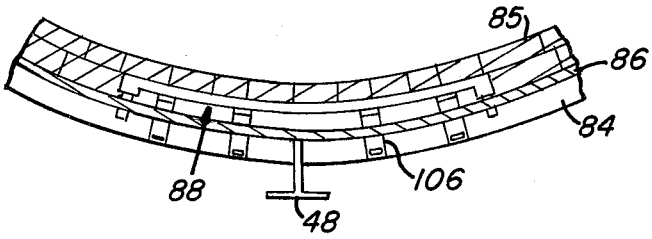
FIG. 7 is a section taken along line 7—7 of FIG. 5.
Figure 10:
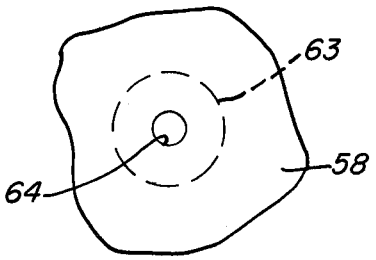
FIG 10 is a view taken along line 10—10 of FIG. 9.
Figure 9:
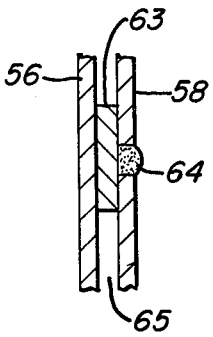
FIG. 9 is an enlarged sectional view taken along line 9—9 of FIG. 6.

The upper shell section 16 is fluid cooled by apparatus constructed according to the present invention. It contains a pair of closely spaced, concentrically disposed, annular metal plates indicated in FIGS. 2 and 4 as inner plate 56 and outer plate 58 that extend throughout the height of the section 16 connecting at opposite ends to upper and lower annular manifolds 60 and 62. Spacing between the plates is maintained, as shown in FIGS. 9 and 10 by a plurality of spacer discs 63 that are tack welded at their periphery to the inner plate 56 and plug welded to the outer plate 58 through openings 64 provided therein. As shown best in FIG. 4 the manifolds 60 and 62 are configured substantially as box headers formed by three rectangularly disposed plate members that enclose three sides of the interior of the respective manifolds. Closure of the manifolds is completed by the connection of the annular plates 56 and 58 between the manifolds, inner plate 56 being attached at its opposite ends to the remote sides of the respective manifolds and outer plate 58 attaching to the facing sides thereof. The two plates form between them a coolant flow passage 65 which conducts low temperature coolant fluid, preferably water, which is supplied under pressure to the lower manifold 62 through a plurality of spaced inlet nipples 66. The heated coolant exits from the upper manifold through discharge nipples 68. In practice the annular plates 56 and 58 are maintained on about three-sixteenths inch spacing which is sufficiently close to provide adequate coolant flow velocity through the passage 65 so as to prevent vaporization of the coolant to occur. Communication between the passage 65 and the respective manifolds is effected by the spaces 70 and 72 defined by the spaced relation that exists between opposite ends of the outer plate 58 and the surfaces of the adjacent manifold plates.

A refractory lining 74 may be applied to the inner surface of the furnace section 16 by the application of courses of refractory brick or gunning material on the facing surface of the inner annular plate 56. If refractory brick is to be applied the bottom course is laid upon an annular shelf 76 that attaches to the lower manifold 62. Subsequent courses are thereafter laid vertically to complete the lining.

Figure 5:
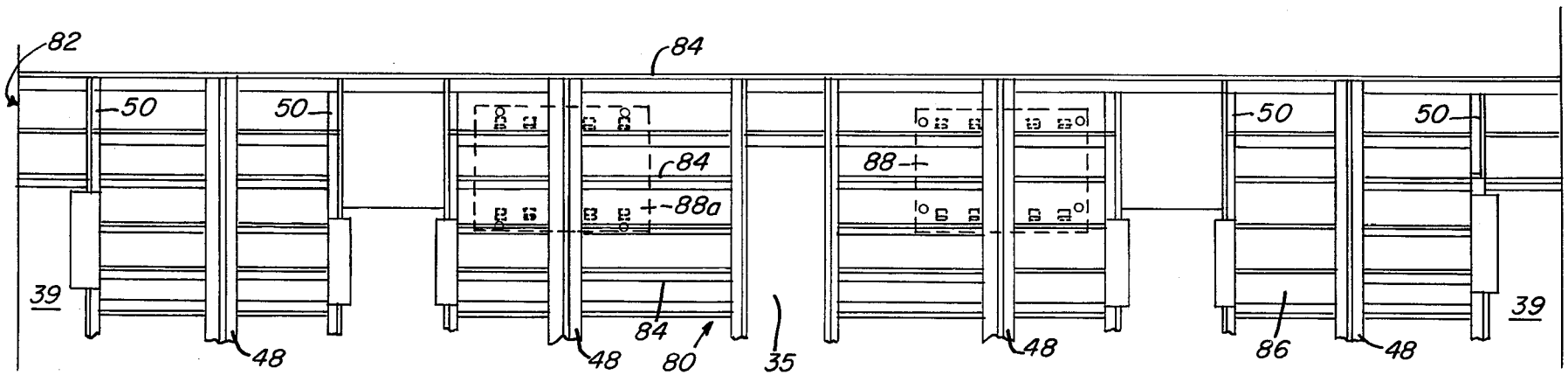
FIG. 5 is a developed view of another form of sidewall construction for an electric furnace employing a modified embodiment of the present invention.

FIG. 5 of the drawing illustrates a developed view of an electric furnace, indicated as 80, of substantially the same general configuration as the furnace 10 of FIG. 1 except that the furnace 80 is constructed with an integral sidewall 82, i.e. one having no split such as that represented as the split line 18 in the FIG. 1 embodiment. In the description of this embodiment of the invention like elements are designated by the same numerals as in the description of the FIG. 1 embodiment.

The furnace sidewall 82 comprises a framing structure that includes upstanding buckstays 48 and columns 50 circumferentially spaced around the periphery of the furnace. The wall further includes a plurality of vertically spaced grid angles 84 that are tied, as by welding, to the respective columns 50 and buckstays 48. A plurality of floating plates 86 are loosely clipped to the angles 84 as well as to buckstays 48 and columns 50 to accommodate thermal expansion of the furnace wall while closing the same. A refractory lining 85 formed of courses of refractory brick or of a layer of monolithic refractory material is provided adjacent the inner surface of the plates 86. An opening 35 in the wall 82 is adapted to communicate with a spout such as that shown at 34 in FIG. 1 for pouring melted charge. A second opening 39 on the opposite side of the wall provides access to the furnace interior.

According to this aspect of the invention the wall 82 is cooled at selected locations by fluid coolant-conducting panels 88. The panels 88 comprise a pair of laterally spaced, vertically extending manifolds 90 and 92 configured substantially as box headers similar to the manifolds 60 and 62 of the FIG. 1 embodiment except that the remote side closures 94 of the headers comprise integral offset portions of the inner panel plate 96 hereinafter described. Fluid supply and discharge nipples 98 and 100 respectively connect the respective manifolds to a source of cooling water.

Figure 6:
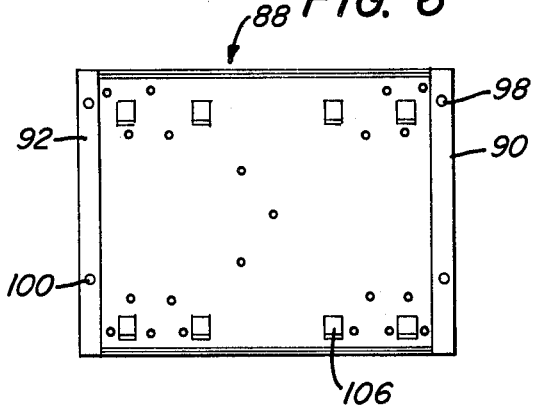
FIG. 6 is an elevational view of one form of fluid cooled, wall panel employed in the furnace sidewall of FIG. 5.
Figure 8:
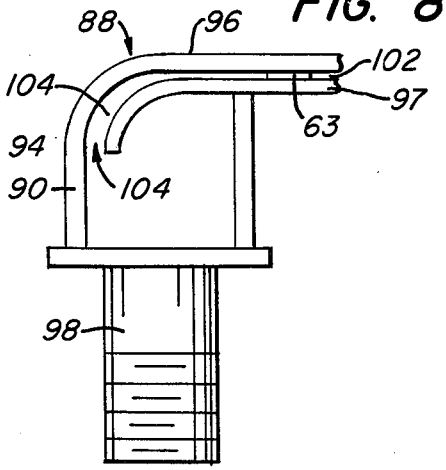
FIG. 8 is an enlarged sectional view similar to the view of FIG. 7 but illustrating the panel interior.

As shown best in FIGS. 6 and 8, the panels 88 contain a pair of closely spaced inner and outer plates, 96 and 97 respectively, that define a coolant flow passage 102 extending between the two manifolds. Spacers 63 similar to those described in connection with the FIG. 1 embodiment and as shown best in FIGS. 9 and 10 maintain spacing between the plates 96 and 97. Communication between the manifolds and opposite ends of the passage 102 is effected by the opening 104 defined between the plates adjacent the opposite ends of the outer plate 97 within the respective manifolds. Mounting brackets 106 are provided at spaced locations about the outwardly facing surface of the outer plate 97 for mounting the panels to the wall. The brackets 106 and angle members having one leg attached to the outer plate 97 and the other leg extending through openings in the floating plates 86 and adapted for connection to the grid angles 84.

Figure 11:
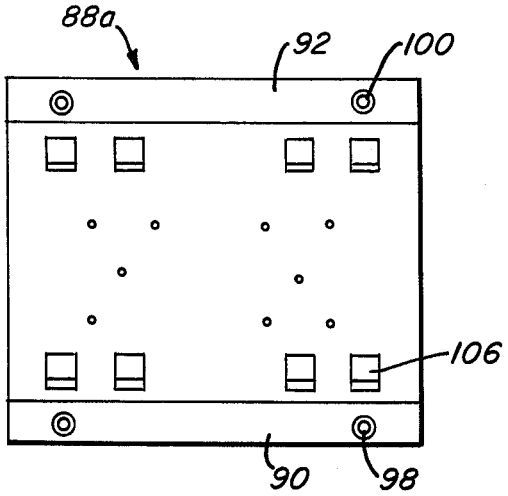
FIG. 11 is an elevational view of another form of fluid cooled wall panel.

It will be appreciated that although, for the sake of simplicity, only one panel 88 is shown applied to the wall of the furnace 80, any number of such panels can be dispersed about the wall's periphery, even to the extent of disposing such panels in contiguous side by side relation so as to cool the entire wall surface. Similarly, the panel can be constructed, as shown at 88*a* in FIG. 11 with the same configuration but with the manifolds 90 and 92 being vertically spaced and laterally extending.

By means of the present invention the walls of a furnace can be effectively cooled, either throughout its entire periphery or at selected locations thereabout. It has been determined that, in utilizing water panels of the described construction, it is possible to continue operation of the furnace following complete erosion of the adjacent refractory lining.

Where a furnace is constructed with a split shell according to the embodiment of FIG. 1 the arrangement has the added advantage that repair and rebricking of the shell can occur at a maintenance station remote from the furnace site. Additionally, the removed shell can be simply replaced by a reserve shell while maintenance or repair is performed on the former thereby reducing down time of the furnace to a minimum.

It will be understood that various changes in the details, materials and arrangements of parts which have been herein described and illustrated in order to explain the nature of the invention, may be made by those skilled in the art within the principle and scope of the invention as expressed in the appended claims.

What is claimed is:

1. For use in a furnace having an interior enclosed by a bottom, a top and at least one upstanding side wall, means for fluid cooling said side wall comprising:

a pair of closely spaced, parallel plates defining a coolant flow passage therebetween;

a plurality of intermittently disposed spacers for maintaining the desired spacing between said plates;

said plates extending substantially parallel with said furnace wall in facing relation to the furnace interior to dispose said coolant flow passage in heat transfer relation therewith;

a pair of oppositely spaced inlet and outlet manifolds coextensive with the ends of said plates and communicating each with one end of said flow passage, said manifolds being box-like headers defined on three sides by rectangularly disposed members and in which said plates extend between and attach the remote members of said headers to define the fourth side thereof, means forming openings in said manifolds for supplying coolant fluid to said inlet manifold for passing the same through said flow passage to discharge from said outlet manifold.

2. Apparatus as recited in claim 1 in which water is said coolant fluid and in which the space between said plates is sufficiently narrow to create a water flow velocity through said passage of sufficient magnitude to prevent steaming.

3. Apparatus as recited in claim 1 in which one of said plates is spaced at its ends from said remote ends of said manifolds to establish fluid communication between said flow passage and said manifolds.

4. Apparatus as recited in claim 1 in which said plates are formed as concentric annuli and said manifolds are ring headers.

5. Apparatus as recited in claim 1 in which said plates include one plate in facing relation to the interior of said furnace and the other plate spaced outwardly therefrom, and each of said manifolds comprising a hollow body whose interior is closed about substantially three sides, said manifolds attaching the respective ends of said plates to complete the closure of said manifold interior, and said other plate containing means for establishing fluid communication between said manifolds and the respective ends of said passage.

6. Apparatus as recited in claim 1 including means for lining the furnace interior facing surface of said one plate with refractory material.

7. Apparatus as recited in claim 6 in which said other plate has its opposite ends spaced from the adjacent manifold wall to connect said passage at its ends in fluid communication with said manifolds.

8. Apparatus as recited in claim 5 in which said spacers comprise substantially circular discs tack welded at their outer periphery to said one plate and plug welded to said other plate through openings provided therein.

* * * * *